US005775698A

United States Patent [19]

Jones et al.

[11] Patent Number: 5,775,698

[45] Date of Patent: Jul. 7, 1998

[54] TARGET CADDY

[76] Inventors: Herbert D. Jones, 12016 White House Rd.; Robert T. Scarborough, 10407 Stallings Creek Dr., both of Smithfield, Va. 23430

[21] Appl. No.: 813,441

[22] Filed: Mar. 10, 1997

[51] Int. Cl.[6] ..... F41J 9/02

[52] U.S. Cl. ..... 273/359; 273/403

[58] Field of Search ..... 273/359, 370, 273/367, 361, 366, 368, 369, 407, 408, 403

[56] References Cited

U.S. PATENT DOCUMENTS

| | | | |
|---|---|---|---|
| 2,726,870 | 12/1955 | Auger . | |
| 3,128,096 | 4/1964 | Hammond et al. | 273/367 |
| 3,303,821 | 2/1967 | Harris | 273/359 |
| 3,391,936 | 7/1968 | Grimes | 273/359 |
| 3,573,867 | 4/1971 | Mehrens | 273/359 |
| 3,917,270 | 11/1975 | Gothard, Jr. et al. | 273/359 |
| 3,947,033 | 3/1976 | Bennett | 273/359 |
| 4,136,874 | 1/1979 | McCord | 273/359 |
| 4,995,618 | 2/1991 | Panzner | 273/370 |
| 5,367,232 | 11/1994 | Netherton et al. . | |
| 5,465,977 | 11/1995 | Mann . | |
| 5,498,001 | 3/1996 | Franks et al. . | |
| 5,568,926 | 10/1996 | Kaptein | 273/359 |

*Primary Examiner*—Mark S. Graham
*Attorney, Agent, or Firm*—Terrance L. Siemens

[57] ABSTRACT

A wheeled carriage for supporting a target. The carriage can be drawn along the ground or alternatively, is self-powered. If self-powered, the carriage optionally includes radio frequency remote controls. Two wheels are preferably mounted on an axle which pivotally engages the carriage, thereby enabling facile turning. The carriage has two upwardly projecting posts for engaging the target. One post is fixed to the carriage and the other is pivotally and horizontally slidably mounted thereto for adjustment in engaging corresponding structure of the target.

6 Claims, 3 Drawing Sheets

TARGET CADDY

BACKGROUND OF THE INVENTION

1. Field of the Invention

The present invention relates to sports targets, and more particularly to an arrangement for providing mobility to a sports target. The novel apparatus includes a wheeled frame having structure for supporting a target and also apparatus for pulling the wheeled frame.

2. Description of the Prior Art

Sports targets have long been employed by those engaging in sports shooting events. In fields such as bow hunting, targets have been designed to simulate real life conditions such as motion of the target. A moving target is shown in U.S. Pat. No. 2,726,870, issued to Albert L. Auger on Dec. 13, 1955. In the subject invention, a target simulating an animal is mounted on a single post to a motorized carriage. The post reciprocatingly inclines when driven from an onboard motor. The motor is further adapted to propel the carriage along the ground. In contrast to Auger's invention, the present invention has two posts for supporting the target, one fixed and one pivotally mounted on the carriage. In different embodiments, both unlike Auger's device, the present invention has a draft cable and remote controlled motor for moving the carriage on the ground.

A motorized system of moving a target about for the purpose of simulating actual motion of an animal is shown in U.S. Pat. No. 5,367,232, issued to Ronald R. Netherton et al. on Nov. 22, 1994. Unlike the present invention, this invention comprises a system attached to static objects, such as trees. The system itself remains in place, only a suspended target moving. There is no wheeled carriage capable of independent motion, as found in the present invention.

U.S. Pat. No. 5,498,001, issued to Johnny D. Franks et al. on Mar. 12, 1996, illustrates the type of target which is movably carried about by the present invention. A simulated animal is supported at two pegs, one located fore and the other located aft on the simulated body.

A target mounted on a wheeled carriage is illustrated in U.S. Pat. No. 5,465,977, issued to Daniel Mann on Nov. 14, 1995. The target comprises a bundle of carpet sections attached to the carriage. There is no structure for mounting a separate target, and certainly not for accommodating the type of target shown in Franks et al.

None of the above inventions and patents, taken either singly or in combination, is seen to describe the instant invention as claimed.

SUMMARY OF THE INVENTION

The present invention provides a mobile carriage for supporting and moving a conventional target simulating an animal. The mobile carriage comprises a wheeled chassis and mounting posts for supporting the target. The carriage is adapted for being moved during target practice so as to add an element of realism and to more closely simulate natural conditions when hunting.

The carriage optionally has a pivotally mounted front axle, for enabling abrupt turns when the target is moving. Propulsion apparatus may be manual, comprising a draw cable, or optionally is motorized. Preferably, if motorized, remote controls are provided for controlling the motor.

The mounting posts project upwardly from the chassis so that the target may be carried about on the carriage in an upright position. One post is fixed to the chassis. The second post is pivotally mounted thereon, to allow for adjustment in mounting targets of different dimensions and configurations. The second post also is horizontally adjustably mounted on the chassis for accommodating targets of different lengths between mounting posts.

Accordingly, it is a principal object of the invention to provide mobile apparatus for supporting a target in an upright position.

It is another object of the invention to enable adjustment in supporting targets of different dimensions and configurations.

It is a further object of the invention to enable the mobile apparatus to be drawn by a person.

Still another object of the invention is to provide a motor for propelling the mobile apparatus along the ground.

An additional object of the invention is to enable remote control of the motor.

It is again an object of the invention to enable the carriage to turn as it traverses the ground.

Yet another object of the invention is to provide a carriage for supporting conventional targets.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
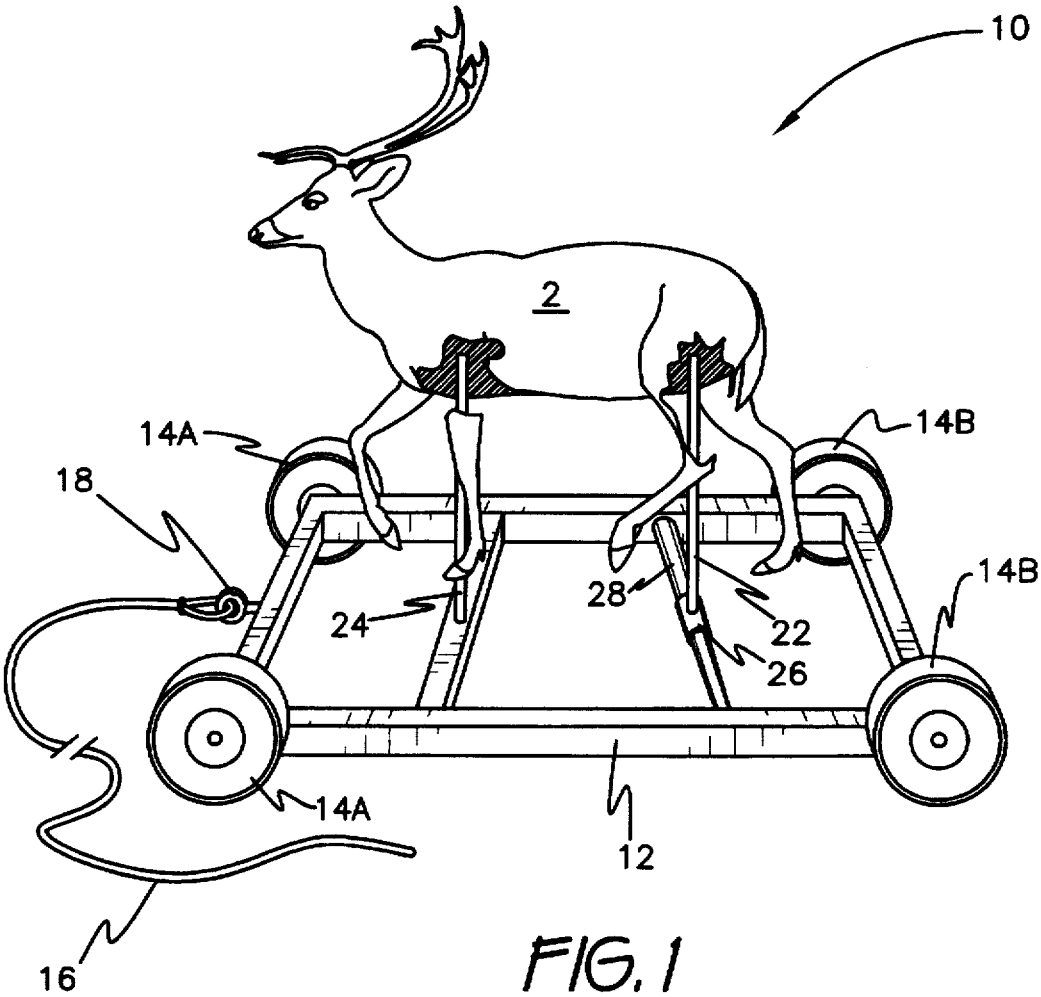
FIG. 1 is a perspective, environmental view of the invention, partially broken away to reveal structure which would normally be concealed within the target.

FIG. 1 of the drawings shows novel carriage 10 for movably supporting a conventional target 2 simulating an animal. Carriage 10 comprises a chassis 12 having four wheels 14A, 14B mounted thereon, so that carriage 10 may be rolled along the ground with target 2 mounted in place, upright on chassis 12. In the embodiment of FIG. 1, carriage 10 is pulled by hand by a draft cable 16 tied to a rigid loop 18 fixed to front frame member 20.

Target 2 is connected to carriage 10 by two upwardly projecting posts 22, 24, which are centrally located along the longitudinal axis of carriage 10. Centrally located signifies that posts 22, 24 are located well inside the periphery of carriage 10, although not necessarily disposed on the longitudinal axis of carriage 10. Front post 24 is rigidly connected to chassis 12 in any suitable way. Rear post 22 is rigidly fixed to a collar 26 which encircles a circular chassis cross member 28. Collar 26 is disposed upon cross member 28 such that there is sufficient friction between these components so as to inhibit spontaneous mutual rotation. However, this friction is limited so that collar 26 may be rotated by hand.

Figure 2:
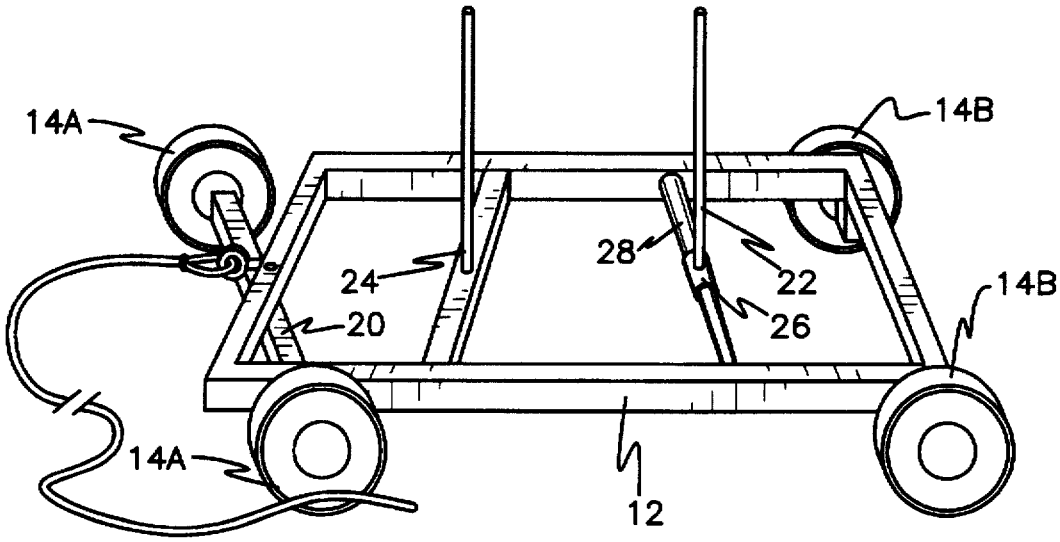
FIG. 2 is a side elevational view of the invention.

The present invention is intended to engage any one of many conventional targets 2 which may be commercially available. Dimensions and configuration of different targets 2 are not predictable. Therefore, ability to move post 22 enables carriage 10 to adjust for targets of different dimensions and configurations. FIG. 2 illustrates a representative degree of pivot available to post 22. The actual amount of pivot may be more or less than that indicated by arrow 30.

FIG. 2 also shows an optional feature enabling steering of carriage 10. A steerable axle 21 is pivotally mounted to frame member 20 by a pin 23 or by any suitable arrangement.

Figure 3:
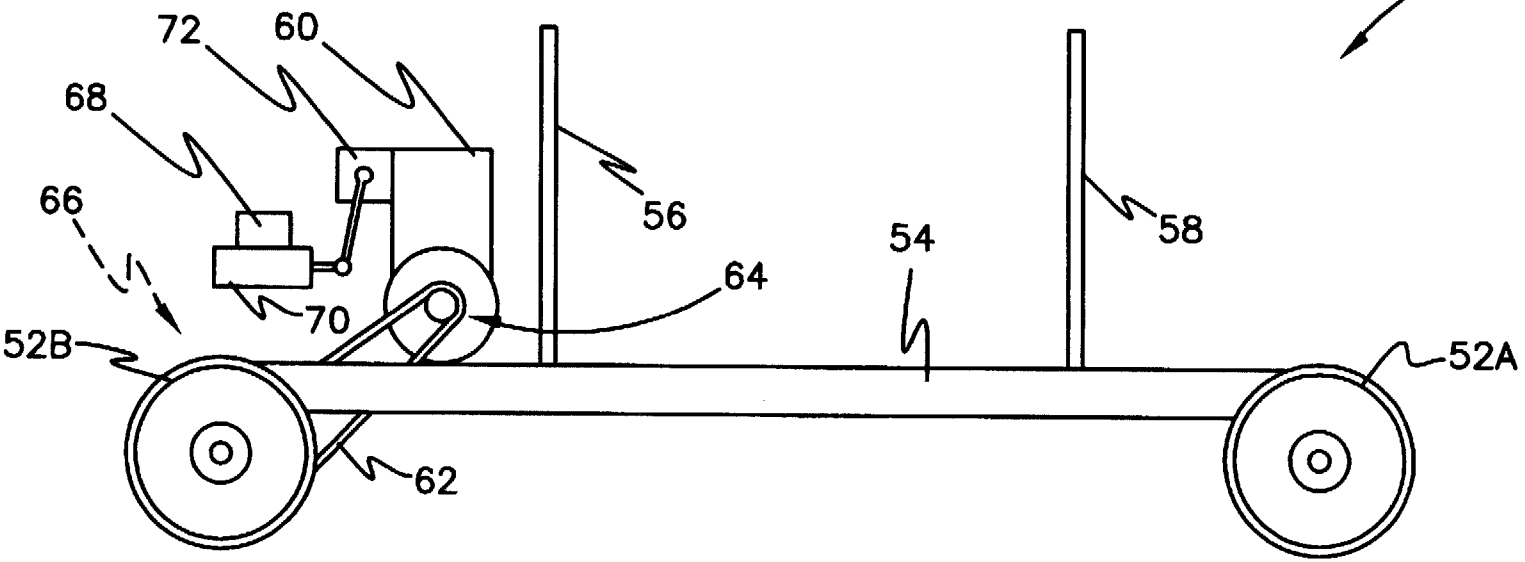
FIG. 3 is a side elevational, diagrammatic view of a second embodiment of the invention.

FIG. 3 illustrates an alternative embodiment of the invention wherein carriage 50 is self-powered. Carriage 50 has front and rear wheels 52A, 52B, a chassis 54, a fixed post 56, and a pivotally mounted post 58, all of which are essentially similar to their counterparts in the embodiment of FIG. 1. It will be understood that post 58 has a collar engaging a corresponding circular member of chassis 54 so that pivoting operation is provided in a manner similar to that of the embodiment of FIG. 1, even though these components are concealed in the view of FIG. 3.

In lieu of draft cable 16 which provided propulsion apparatus in the embodiment of FIG. 1, the embodiment of FIG. 3 has a motor 60 supported by chassis 54. Motor 60 may be a small, single cylinder internal combustion engine of well known nature, which drives a wheel 52B by a suitable drive train. Illustratively, this drive train may comprise a belt 62 carried on a pulley 64, driven by motor 60, and a pulley 66 attached to a wheel 52B.

Motor 60 is remotely controlled by the following arrangement. A radio receiver 68 is controllably associated with a transducer 70 of any well known type. Transducer operates the throttle of a carburetor 72 serving motor 60. Remote control enables operating personnel (not shown) to remain spaced away from carriage 50 while causing carriage 50 to be propelled along the ground during the course of target practice.

Figure 4:
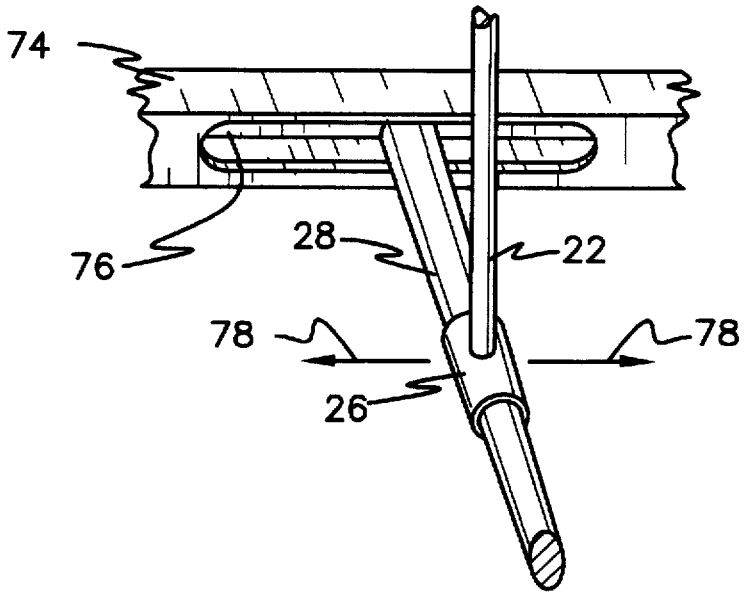
FIG. 4 is a perspective detail view of an adjustment feature of a preferred embodiment.

FIG. 4 illustrates an adjustment which may be provided regardless of power source. In a preferred embodiment, cross member 28 is slidably mounted to lateral member 74 of chassis 12. Cross member 28 is fixed to a slidable member 76 which is entrapped and slides only horizontally within member 74, as indicated by arrows 78. This adjustability enables carriage 10 to be compatible with targets of variable dimension from post 22 to post 24.

The present invention is susceptible to many variations and modifications which may be proposed by those of skill in the art. For example, the number of wheels may be varied to suit. Only one wheel may be disposed upon frame member 20 or axle 21, rather than the two wheels depicted in FIG. 1. Axle 21 may be disposed at the rear rather than at the front of carriage 10.

Motor 60 may comprise an electric or pneumatic motor, if desired, with controls being rearranged accordingly. Regardless of the type of motor, it will preferably be located in a concealed position with respect to chassis 12 or 54, so that it is protected from damage due to projectiles which fail to strike the target.

Posts 22, 24 may be replaced by or augmented by sockets (not shown), for adapting targets having their own downwardly projecting posts to be compatible with posts 22, 24.

It is to be understood that the present invention is not limited to the embodiments described above, but encompasses any and all embodiments within the scope of the following claims.

We claim:

1. A carriage having a hunting target, comprising:

a chassis having a plurality of wheels mounted on said chassis, for rolling said chassis along the ground, said chassis having a first centrally located, upwardly projecting post and a second centrally located, upwardly protecting post, said first post and said second post adapted to engage said target, said first post fixed to said chassis and said second post having structure enabling only horizontal adjustment for varying the dimension between said first post and said second post, said chassis also having propulsion means for propelling said carriage on the ground while maintaining operating personnel spaced away from said carriage;

said target having openings cooperating with said first post and said second post such that said target is mounted to said chassis on said first post and said second post.

2. The carriage according to claim 1, said second post having structure enabling pivotal adjustment with respect to said chassis, whereby said carriage is adjustable for different said targets.

3. The carriage according to claim 1, said propulsion means comprising a draft cable and means for attaching said draft cable to said chassis.

4. The carriage according to claim 1, said propulsion means comprising a motor and drive train drivably connecting at least one of said wheels to said motor.

5. The carriage according to claim 4, said propulsion means further comprising remote control for remotely controlling said motor.

6. The carriage according to claim 1, said carriage further having an axle supporting at least one of said wheels, said axle disposed at one end of said carriage, said carriage further comprising means for turning said axle.

* * * * *